United States Patent [19]

Golembeck et al.

[11] 4,052,760

[45] Oct. 11, 1977

[54] COIL SPRING ASSEMBLY

[75] Inventors: Gerald A. Golembeck, Lake Elmo; Ralph J. Marx, St. Paul, both of Minn.

[73] Assignee: The United States Bedding Company, St. Paul, Minn.

[21] Appl. No.: 660,763

[22] Filed: Feb. 23, 1976

[51] Int. Cl.[2] ..... A47C 23/04

[52] U.S. Cl. ..... 5/248; 5/256; 5/351; 5/DIG. 2

[58] Field of Search ..... 5/248, 256, 260, 261, 5/351, DIG. 2

[56] References Cited

U.S. PATENT DOCUMENTS

| | | | |
|---|---|---|---|
| 2,192,463 | 3/1940 | Wesley | 5/351 |
| 2,773,270 | 12/1956 | Rozelle | 5/351 |
| 3,092,849 | 6/1963 | Clifton | 5/351 |
| 3,166,768 | 1/1965 | Cunningham | 5/351 |
| 3,626,573 | 12/1971 | Robins | 5/351 |

*Primary Examiner*—Casmir A. Nunberg
*Attorney, Agent, or Firm*—McDougall, Hersh & Scott

[57] ABSTRACT

A coil spring assembly for mattresses and box springs in which the coil springs are arranged in lengthwise and crosswise rows in the assembly with the outermost coil springs in each of the rows and in the middle rows extending lengthwise of the spring assembly being formed of coil springs of greater firmness than the coil springs in the lengthwise rows immediately adjacent the outermost rows but in which the number of rows formed of coil springs of greater firmness is at least equal to if not greater than the number of rows of coil springs of less firmness.

1 Claim, 5 Drawing Figures

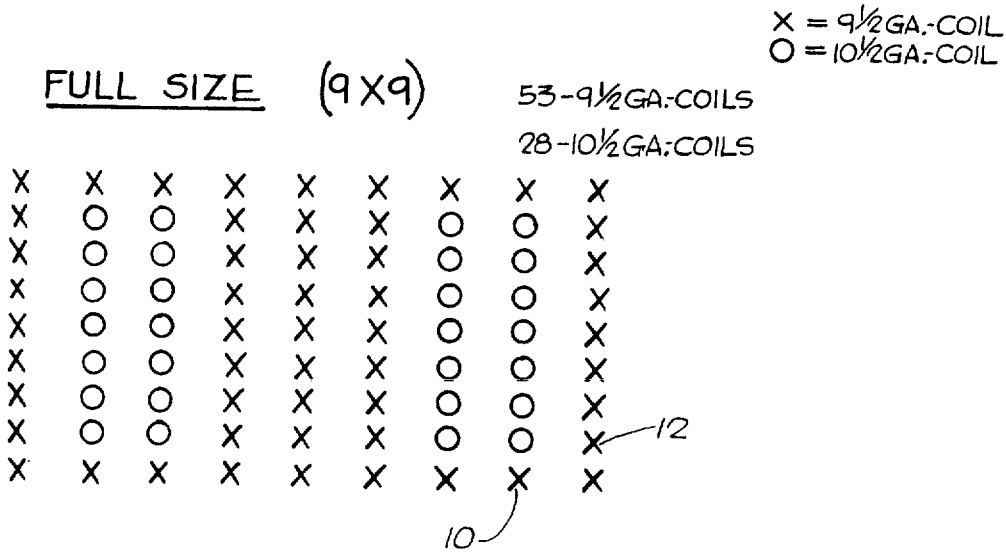

X = 9½ GA.-COIL
O = 10½ GA.-COIL

FULL SIZE (9X9)

53-9½ GA.-COILS
28-10½ GA.-COILS

| | | | | | | | | |
|---|---|---|---|---|---|---|---|---|
| X | X | X | X | X | X | X | X | X |
| X | O | O | X | X | X | O | O | X |
| X | O | O | X | X | X | O | O | X |
| X | O | O | X | X | X | O | O | X |
| X | O | O | X | X | X | O | O | X |
| X | O | O | X | X | X | O | O | X |
| X | O | O | X | X | X | O | O | X |
| X | O | O | X | X | X | O | O | X |
| X | X | X | X | X | X | X | X | X |

12

10

FIG. 1

FULL KING SIZE (9X10)

62-9½ GA.-COILS
28-10½ GA.-COILS

| | | | | | | | | | |
|---|---|---|---|---|---|---|---|---|---|
| X | X | X | X | X | X | X | X | X | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | X | X | X | X | X | X | X | X | X |

FIG. 2

QUEEN SIZE (10X10)

68-9½ GA.-COILS
32-10½ GA.-COILS

| | | | | | | | | | |
|---|---|---|---|---|---|---|---|---|---|
| X | X | X | X | X | X | X | X | X | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | O | O | X | X | X | X | O | O | X |
| X | X | X | X | X | X | X | X | X | X |

FIG 3

X = 9½ GA. COIL
O = 10½ GA. COIL

2/6 (SPLIT QUEEN) KING SIZE (5X10) 38 - 9½ GA. COILS
12 - 10½ GA. COILS

| | | | | | | | | | |
|---|---|---|---|---|---|---|---|---|---|
| X | X | X | X | X | X | X | X | X | X |
| X | O | O | X | X | X | X | O | O | X |
| X | O | O | X | X | X | X | O | O | X |
| X | O | O | X | X | X | X | O | O | X |
| X | X | X | X | X | X | X | X | X | X |

FIG. 4

TWIN SIZE (6X9) 38 - 9½ GA. COILS
16 - 10½ GA. COILS

| | | | | | | | | |
|---|---|---|---|---|---|---|---|---|
| X | X | X | X | X | X | X | X | X |
| X | O | O | X | X | X | O | O | X |
| X | O | O | X | X | X | O | O | X |
| X | O | O | X | X | X | O | O | X |
| X | O | O | X | X | X | O | O | X |
| X | X | X | X | X | X | X | X | X |

FIG. 5

COIL SPRING ASSEMBLY

This invention relates to spring assemblies for mattresses and box springs.

Spring assemblies used in mattresses and box springs have been subject to failure because of premature sag whereby the comfort factor falls rapidly and the mattresses or box springs become unfit for use.

The art has sought to firm up the edges of the spring assembly by the use of various types of edge supports of edge walls, but these comprise additional elements which tend to complicate the assembly and increase the cost without alleviating premature sag. Thus the comfort or the useful life of the mattress or spring assembly is not materially improved.

It is an object of this invention to produce a spring assembly for use in mattresses and box springs in which firmness is more uniformly distributed throughout the mattress or box spring markedly to increase the comfort of the mattress or box spring; in which the spring assembly is formed of coil springs without the need for additional stiffeners or supports which tend to complicate the assembly and raise the cost thereof; in which premature sag is substantially completely eliminated thereby to increase the useful life of the spring assembly and box springs, and in which the coil springs are capable of being assembled in a simple and efficient manner to produce a spring assembly which offers better, more uniform, and increased firmness without corresponding increase in the stiffness of the coil springs of which the assembly is formed.

These and other objects and advantages of this invention will hereinafter appear and, for purposes of illustration, but not of limitation, embodiments of the invention are shown in the accompanying drawings in which -

FIG. 1 is a schematic illustration of the arrangement of coil springs in a spring assembly embodying the features of this invention for a full size bed;

FIG. 2 is a view similar to that of FIG. 1 showing the arrangement of coil springs for a full king size bed;

FIG. 3 illustrates the arrangement of coil springs for a queen size bed;

FIG. 4 illustrates the arrangement of coil springs for a split queen bed; and FIG. 5 illustrates the arrangement of coil springs, in accordance with the practice of this invention, in a twin size bed.

Briefly described, a coil spring assembly embodying the features of this invention is made up of a plurality of coil springs arranged in a plurality of lengthwise and crosswise extending rows 10 and 12 respectively, with the outermost coil springs in the lengthwise and crosswise rows and in the middle rows extending lengthwise of the spring assembly, having greater firmness than the coil springs remaining in the rows immediately adjacent the outermost lengthwise rows of the coil spring, with the number of lengthwise rows of coil springs of greater firmness constituting at least half of the lengthwise rows of coil springs in the spring assembly.

The concept outlined above will now be illustrated with reference to the arrangement of coil springs in spring assemblies for various common bed sizes, using two species of coil springs, one identified by the letter (X) formed of 9½ gauge spring wire, in which a single coil spring requires 13 pounds for a one inch axial compression, the other species being identified by the letter (O) formed of 10½ gauge wire in which a single coil spring requires 8 pounds for a one inch axial compression.

FIG. 1 illustrates the coil spring arrangement in a spring assembly for a full size bed. The coils are arranged in lengthwise and crosswise extending rows 10 and 12 respectively, with nine rows extending in the lengthwise direction and nine rows extending in the crosswise direction. The outermost coil springs in each of the rows are of the firmer coil springs (X). The coil springs in the three middle lengthwise rows are also of the firmer coils (X) while the remainder of the coils in the two lengthwise rows immediately adjacent the outermost rows are of the lesser firmness (O). Thus the spring assembly is formed with five rows of coil springs of greater stiffness and four rows of coil springs of lesser stiffness, except for the outermost coil springs in each of the rows.

In FIG. 2, illustration is made of a full king size bed having the coil springs arranged in ten lengthwise rows and nine crosswise rows. Again the outermost coil spring in each of the lengthwise and crosswise rows are of the coil springs of greater firmness (X), the four middle rows extending in the lengthwise direction are of the species of coil springs having greater firmness (X) while the two lengthwise extending rows immediately adjacent the outermost rows are of the lesser firmness variety (O), except for the outermost coil springs in the rows. This adds up to six lengthwise extending rows of firmer coil springs and four lengthwise extending rows of less firm coil springs.

In FIG. 4, illustration is made of the coil spring arrangement for use in a split queen size bed in which the coil springs are arranged in ten lengthwise extending rows and five crosswise extending rows. Again, the outermost coil springs in each of the lengthwise and crosswise extending rows are of the firmer variety (X). The four middle rows extending in the lengthwise direction are formed of coil springs of the firmer variety (X) while the two lengthwise rows adjacent each of the outermost rows are formed of coil springs of the less firm variety (O), except for the outermost coil springs in said rows. This amounts to six rows of coil springs of the firm variety (X) and four rows of coil springs os the less firm variety (O).

In FIG. 5, illustration is made of the coil spring arrangement for a twin size bed in which the coil springs are arranged in nine lengthwise extending rows and six crosswise extending rows. The outermost coil springs in each of the lengthwise and crosswise extending rows are of the firm variety (X). The three middle rows extending in the lengthwise directon are formed of coil springs of the firmer variety (X) while the two lengthwise extending rows immediately adjacent each of the outermost rows are formed of coil springs of the less firm variety (O), except for the outermost coil springs in each of said rows. This adds up to five rows of coil springs of the firmer variety (X) and four rows of coil springs of the less firm variety (O).

In each of the assemblies, the coil springs are arranged in lengthwise and crosswise extending rows with the outermost coil springs in each of the crosswise and lengthwise extending rows and in the middle rows being of the variety having greater firmness while the remainder of the coil springs in the lengthwise rows adjacent the outermost rows are of lesser firmness, with the number of lengthwise rows of coil springs of greater firmness or at least equal to the number of lengthwise rows of coil springs of lesser firmness, and preferably greater.

The invention is not restricted to coil springs of a particular size, gauge, or firmness, except that the concepts of this invention depend on the combination of firm and not so firm coil springs in the one assembly, arranged as described.

To complete the spring assembly, the terminal coils of the outermost coil springs are connected to upper and lower border wires, as by means of helical tie wires or clips. The coil springs are interconnected one to another in the lengthwise and crosswise rows either by helical tie wires or by metal or plastic clips which interconnect the terminal coils of the adjacent oil springs, or by tie wires which extend alongside the terminal coils of the coil springs in a row and are connected to the terminal coils either by clips or by twisting a chord portion of the terminal coils about the tie wires.

Thereafter, in forming a mattress, the coil spring assembly is covered with a cushioning layer and then enclosed by ticking and/or a mattress cover.

The spring assemblies of this invention provide greater comfort and support as well as preventing premature sag thereby to increase the useful life of the mattress or box spring. No edge supports are required and assembly is thereby greatly simplified. A mattress characterized by greater firmness is obtained without the need to fabricate the spring assembly entirely out of the more expensive firmer variety of coil springs.

It will be understood that changes may be made in the details of construction, arrangement and operation without departing from the spirit of the invention, especially as defined in the following claims.

We claim:

1. A coil spring assembly for mattresses and box springs characterized by improved comfort and support in which the coil spring assembly is formed of coil springs arranged in a plurality of lengthwise and crosswise extending rows and in which the coil springs consist of two sets of coil springs in which the coil springs of both sets are of the same size but in which the coil springs of one set are of lower gauge and greater stiffness than the coil springs of the other set with the outermost coil springs in each of the lengthwise and crosswise extending rows and in the middle rows extending lengthwise of the spring assembly being of the one set while the coil springs remaining in the rows adjacent the outermost lengthwise rows being of the other set with the number of lengthwise rows of coil springs of the one set comprising at least half of the lengthwise rows of coil springs in the spring assembly.

* * * * *